US011319841B2

(12) United States Patent
Van Wingerden et al.

(10) Patent No.: US 11,319,841 B2
(45) Date of Patent: May 3, 2022

(54) HYBRID VARIABLE VALVE ACTUATION SYSTEM

(71) Applicant: Eaton Intelligent Power Limited, Dublin (IE)

(72) Inventors: Mark Van Wingerden, Battle Creek, MI (US); Douglas J. Nielsen, Marshall, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/266,747

(22) PCT Filed: Aug. 7, 2019

(86) PCT No.: PCT/EP2019/025262
§ 371 (c)(1),
(2) Date: Feb. 8, 2021

(87) PCT Pub. No.: WO2020/030299
PCT Pub. Date: Feb. 13, 2020

(65) Prior Publication Data

US 2021/0310380 A1 Oct. 7, 2021

Related U.S. Application Data

(60) Provisional application No. 62/716,201, filed on Aug. 8, 2018.

(51) Int. Cl.
*F01L 1/26* (2006.01)
*F01L 1/18* (2006.01)
(Continued)

(52) U.S. Cl.
CPC ..... *F01L 1/181* (2013.01); *F01L 1/2405* (2013.01); *F01L 1/26* (2013.01); *F01L 13/0005* (2013.01); *F01L 13/06* (2013.01); *F01L 1/2411* (2013.01)

(58) Field of Classification Search
CPC ..... F01L 1/181; F01L 1/2405; F01L 1/2411; F01L 1/26; F01L 13/0005; F01L 13/06
(Continued)

(56) References Cited

U.S. PATENT DOCUMENTS 3,963,004 A * 6/1976 Lysinger ..... F01L 1/181 123/90.4
4,825,822 A 5/1989 Muranaka et al.
(Continued)

OTHER PUBLICATIONS

International Search Report and Written Opinion for PCT/EP2019/025262, dated Oct. 11, 2019; pp. 1-10.

*Primary Examiner* — Jorge L Leon, Jr.
(74) *Attorney, Agent, or Firm* — Mei & Mark, LLP

(57) ABSTRACT

A valvetrain assembly comprises a valve bridge, a capsule, a first rocker arm, and a second rocker arm. The valve bridge comprises an upper surface comprising a central pressure point and an offset pressure point and a lower surface comprising a lower pivot point, a first valve interface, and a second valve interface. The capsule can be connected to the lower pivot point, the capsule configured to provide to the pair of engine valves one or both of a lash adjusting function and a deactivating mode. The first rocker arm is configured to actuate against the central pressure point to transfer a first valve lift mode to the valve bridge. The second rocker arm is configured to actuate against the offset pressure point to transfer a second valve lift mode to the valve bridge.

15 Claims, 5 Drawing Sheets

(51) Int. Cl.
*F01L 13/00* (2006.01)
*F01L 13/06* (2006.01)
*F01L 1/24* (2006.01)

(58) Field of Classification Search
USPC ..... 123/90.4, 90.44, 90.46, 90.55
See application file for complete search history.

(56) References Cited

U.S. PATENT DOCUMENTS

| | | | | | |
|---|---|---|---|---|---|
| 4,924,821 | A | | 5/1990 | Teerman | |
| 5,261,361 | A | * | 11/1993 | Speil | F01L 1/26 123/90.22 |
| 5,303,680 | A | | 4/1994 | Nielsen | |
| 5,365,894 | A | | 11/1994 | Hackett | |
| 5,492,086 | A | * | 2/1996 | Kuhns | F01L 1/053 123/195 C |
| 6,085,705 | A | | 7/2000 | Vorih | |
| 6,659,056 | B2 | | 12/2003 | Sweetland | |
| 7,392,777 | B2 | | 7/2008 | Faria et al. | |
| 7,484,483 | B2 | | 2/2009 | Yang et al. | |
| 7,509,933 | B2 | | 3/2009 | Dingle | |
| 9,512,745 | B2 | | 12/2016 | Cecur | |
| 2010/0071643 | A1 | | 3/2010 | Smith et al. | |
| 2010/0170471 | A1 | * | 7/2010 | Yang | F01L 1/08 123/321 |
| 2015/0354418 | A1 | * | 12/2015 | Jo | F01L 9/12 123/323 |
| 2018/0003088 | A1 | | 1/2018 | Nielsen et al. | |
| 2018/0087413 | A1 | | 3/2018 | Xi et al. | |

* cited by examiner

HYBRID VARIABLE VALVE ACTUATION SYSTEM

This is a § 371 National Stage Entry of Patent Cooperation Treaty Application No. PCT/EP2019/025262, filed Aug. 7, 2019 which claims the benefit of U.S. provisional application No. 62/716,201, filed Aug. 8, 2018, all of which are incorporated herein by reference.

FIELD

This application provides a type III center pivot type valvetrain with end pivoting valve bridges and variable valve actuation techniques.

BACKGROUND

Valvetrains are designed to provide valve opening and closing functions for combustion cylinders. It is desired to provide for variances, sometimes called lash, in the valve actuation. When providing for these variances, it is important to prevent the lash adjusting mechanism from causing its own undesired variances as can happen if the lash adjuster pumps up and overextends or if the lash adjuster pumps down and becomes spongy.

SUMMARY

The methods and devices disclosed herein overcome the above disadvantages and improves the art by providing a valvetrain that prevents the lash adjuster from pumping up or pumping down while additional variable valve actuation techniques are used. Engine braking and cylinder deactivation can be used without the lash adjuster adding undesired variances to the valvetrain.

A valvetrain assembly comprising a valve bridge, a capsule, a first rocker arm, and a second rocker arm. The valve bridge comprises an upper surface comprising a central pressure point and an offset pressure point and a lower surface comprising a lower pivot point, a first valve interface, and a second valve interface. The first and second valve interfaces can be configured to press on a corresponding pair of engine valves. The capsule can be connected to the lower pivot point, the capsule configured to provide to the pair of engine valves one or both of a lash adjusting function and a deactivating mode. The first rocker arm is configured to actuate against the central pressure point to transfer a first valve lift mode to the valve bridge. The second rocker arm is configured to actuate against the offset pressure point to transfer a second valve lift mode to the valve bridge.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures.

Figure 1:
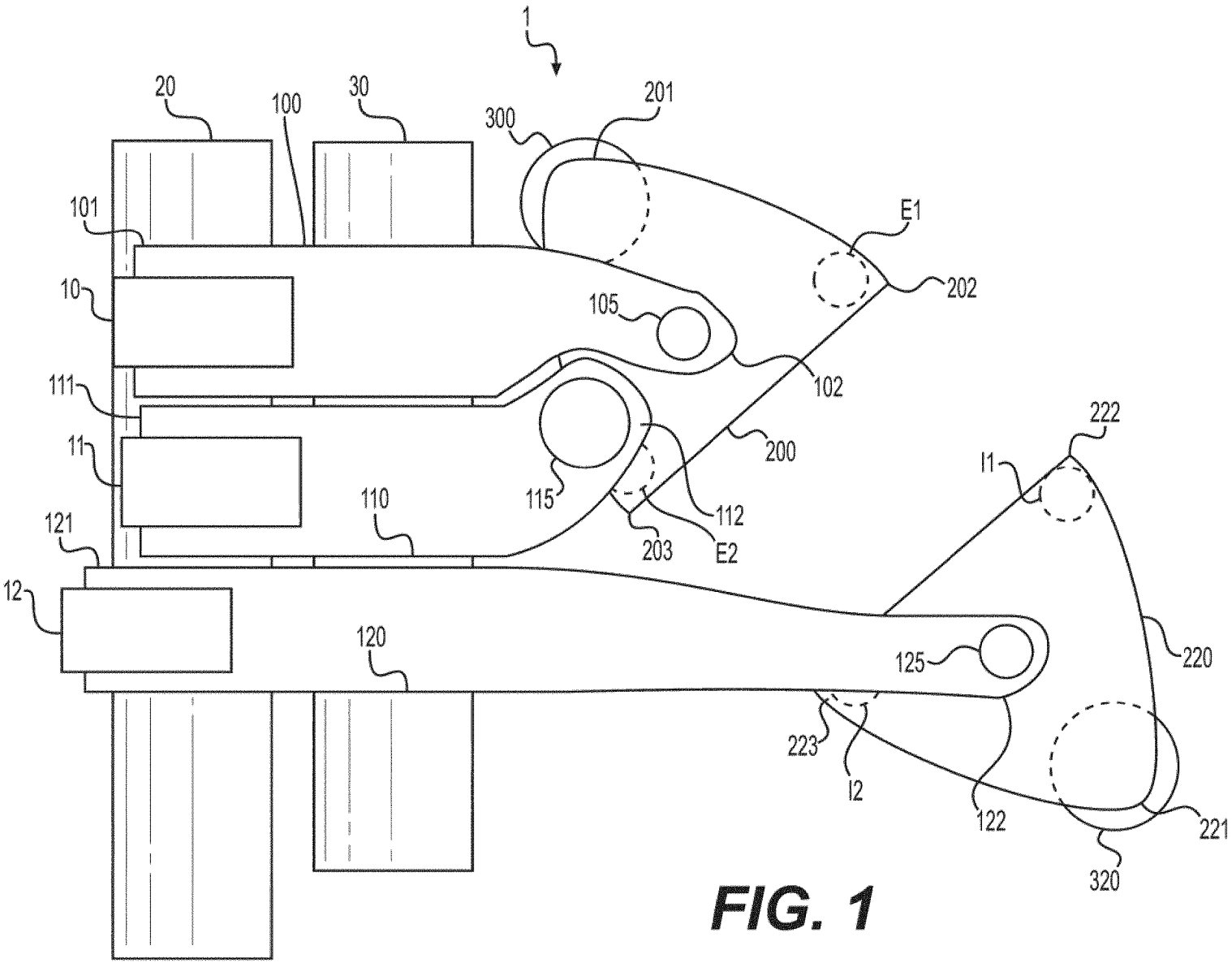
FIG. 1 is a view of a valvetrain assembly.

A valvetrain assembly 1-4 comprises a valve bridge 200 a capsule 300, a first rocker arm 100, and a second rocker arm 110. A third rocker arm 120 can be associated with a second valve bridge 220 and capsule 320. First ends 101, 111, 121 of the rocker arms 100, 110, 120 comprise respective roller bearings 10, 11, 12 or tappets abutting a cam rail 20. Cam rail 20 can further comprise cam lobes and can be multiple pieces or unitary. The cam rail 20 can be configured to transfer valve lift profiles to the rocker arms to enable various valve actuation modes. For example, rocker arm 120 can be an intake rocker arm with an intake valve lift profile corresponding to a normal mode or a late intake valve closing mode (LIVC), among others. Rocker arm 100 can be an exhaust rocker arm with an exhaust valve lift profile corresponding to a normal mode or an early exhaust valve opening mode (EEVO), among others. Rocker arm 110 can be configured to actuate engine braking (EB) or another valve actuation technique such as late exhaust valve closing (LEVC), or late exhaust valve opening (LEVO), among others. Techniques such as negative valve overlap (NVO), internal exhaust gas recirculation (iEGR), intake recharge (iRC), among others, can be enabled. Many other combinations and alternatives are possible within the teachings of the disclosure. Inasmuch as FIG. 1 is designated as an exhaust side and an intake side, the functionality of the described exhaust side valve assembly can be duplicated or transferred to the intake side.

It can be said then that the valvetrain assembly comprises a second rocker arm 110 configured to provide an engine braking mode as a second valve lift mode. It can also be said that the valvetrain assembly comprises a second rocker arm 110 configured to provide one of an early exhaust valve opening mode and a late intake valve closing mode as the second valve lift mode.

Rocker arms 100, 110, 120 can rotate about rocker shaft 30 when actuated on by cam rail 20 and thereby transfer motion to rocker arm ends 102, 112, 122. The rocker arm ends 102, 112, 122 press on respective valve bridges 200, 220 to actuate respective valves E1, E2 & I1, I2.

The valve bridge 200 comprises an upper surface comprising a central pressure point 204, 235 and an offset pressure point 2331 or 2332. An elephant foot (e-foot) or other joint, socket, or other coupling at locations 105, 115 can transfer forces to the valve bridge 200. Valve bridge 200 further comprises a lower surface comprising a lower pivot point 2352, a first valve interface 2351, and a second valve interface, the first and second valve interfaces at ends 202 & 203 and the lower pivot point at end 201 of the valve bridge 200. The first and second valve interfaces 2351 can be configured to press on a corresponding pair of engine valves E1, E2. The capsule 300 can be connected to the lower pivot point 2352 such as in a socket or by an extension among others. Rocker arm 120 is shown with actuating end 122 comprising a location 125 pressable on a central pressure point of valve bridge 220 so that the valve bridge 220 can pivot at end 221 on capsule 320 and valves I1, I2 can lift and lower on valve bridge ends 222, 223.

The capsule 300 or 320 are configured to provide to the pair of engine valves E1, E2, I1,I2 one or both of a lash adjusting function and a deactivating mode (cylinder deactivation "CDA" or other lost motion function). The first rocker arm 100 is configured to actuate against the central pressure point 204, 235 to transfer a first valve lift mode to the valve bridge 200. The second rocker arm 110 is configured to actuate against the offset pressure point 2331 or 2332 to transfer a second valve lift mode to the valve bridge 200.

Figure 3:
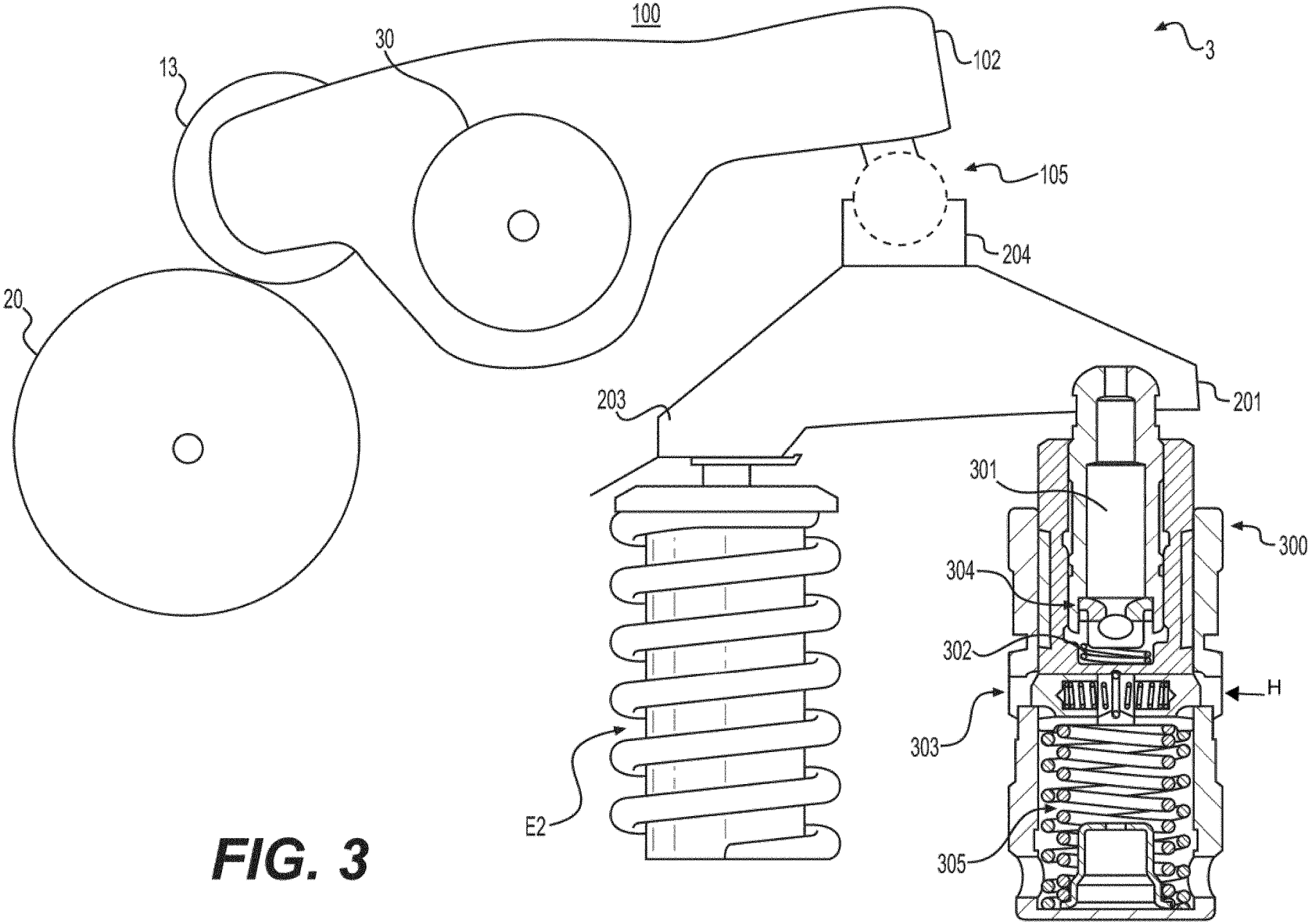
FIGS. 3 & 4 are views of variant valvetrain assemblies.

The capsule 300, 320 can be further configured to provide the pair of engine valves E1, E2 the lash adjusting function and to selectively provide the deactivating mode. An example of such a capsule can be seen in FIG. 3. A hydraulic lash assembly can be provided with an upper lash chamber 301, a check assembly 304, and a lower lash chamber 302 arranged over a deactivatable latch assembly 303. Hydraulic control H to the latch assembly 303 can compress the latches so that pressure to pivot point on end 201 pushes the hydraulic lash assembly down towards the lost motion chamber 305. Lost motion chamber 305 can comprise a lost motion spring to bias the deactivatable latch assembly 303 and hydraulic lash assembly back upwards towards the valve bridge 200.

Figure 2A:
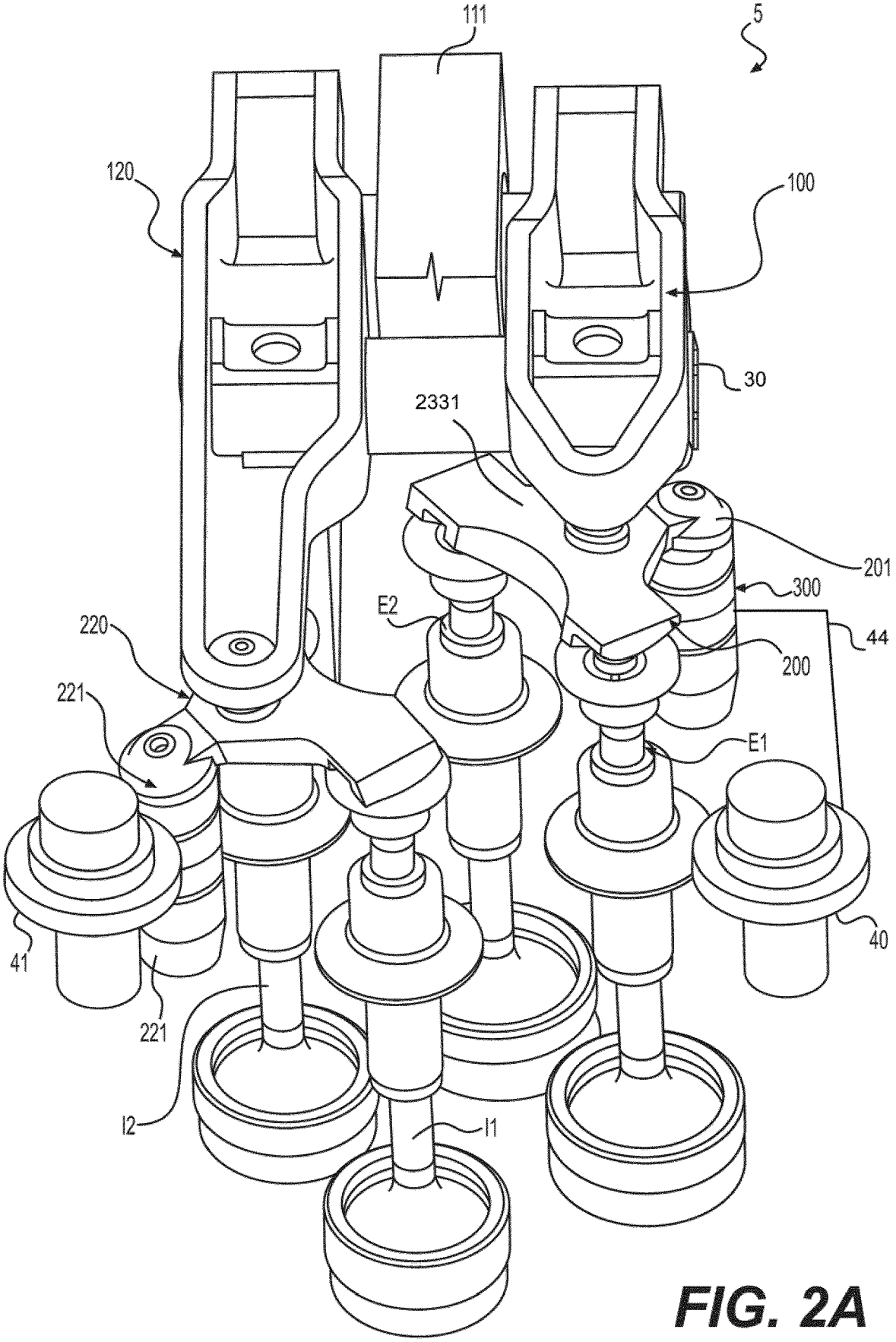
FIGS. 2A & 2B are views of alternative valvetrain assemblies.
Figure 2B:
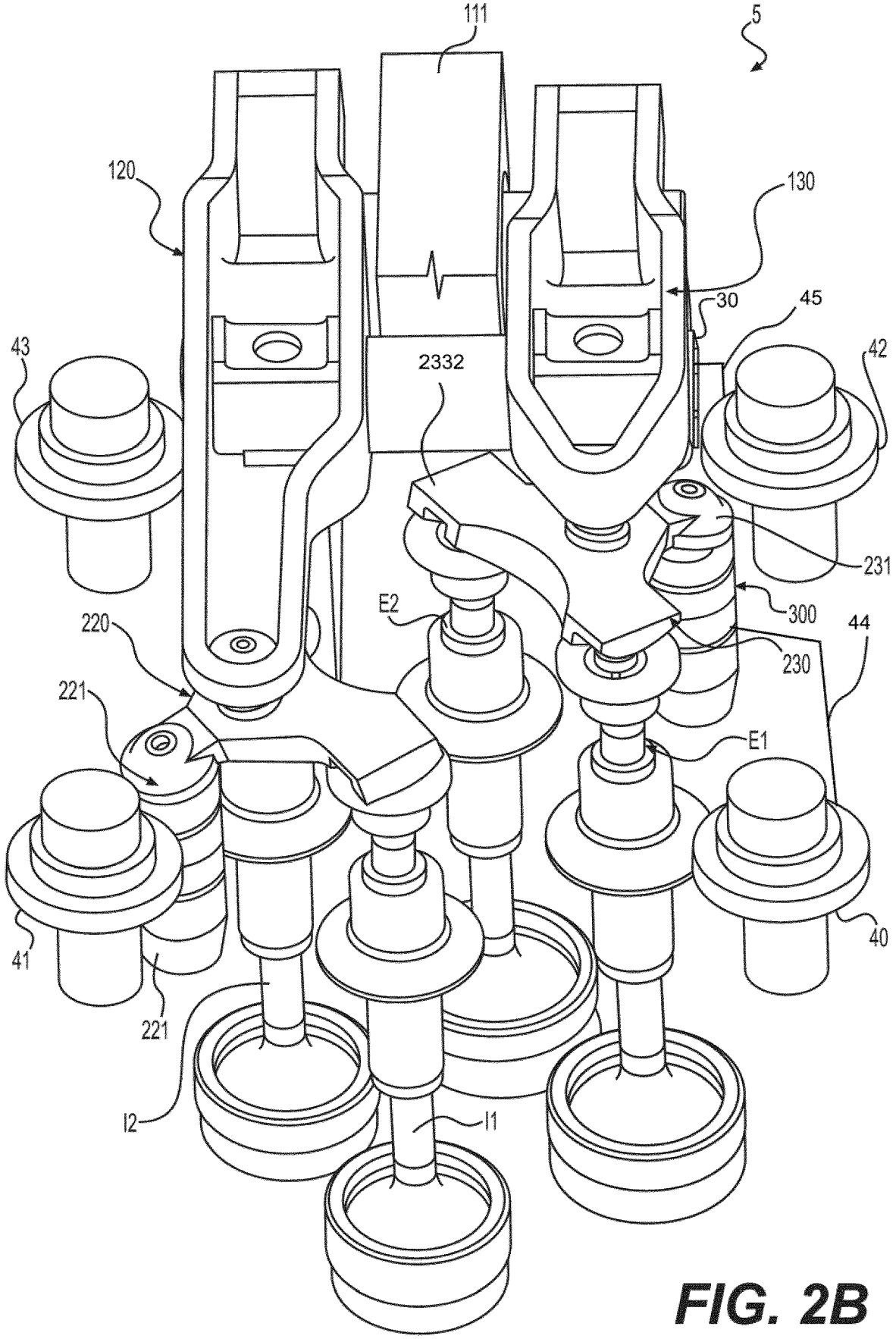

If the lash adjuster, which can be a hydraulic lash adjuster (HLA) or mechanical lash adjuster, is in the pivot point 201 (with or without the deactivating latch assembly), the second rocker arm 110 must act on the inside of the valves E1, E2, between the valves and the first rocker arm 100. This leads to a configuration like FIG. 1, where the offset pressure point 2331 is located between the central pressure point 204 and a location above the first valve interface at end 203. The offset pressure point 2331 can be at a location bounded by the central pressure point 204, the first valve interface at end 203, and the second valve interface at end 202. The second rocker arm coupling location 115 does not actuate directly over the valves. FIGS. 2A & 2B have a cut-away of second rocker arm 110 to indicate the offset pressure point 2331.

With this configuration comprising the lash adjustment function and the deactivation mode in the tower or other engine block coupling, the first rocker arm and the second rocker arm do not require one or more internal hydraulic supplies in order to supply the lash adjusting function, the deactivating mode, or the engine braking mode to the corresponding pair of engine valves. This simplifies the internals of the rocker arms 100, 110. It also simplifies the oil galleries. In FIG. 2A, this can be seen because there is only oil control valve 40 adjacent capsule 300, but no oil control valve adjacent rocker shaft 30. If the intake side is similarly configured as the exhaust side, having the capsule 320 configured like capsule 300, then only oil control valve 41 is needed on the intake side and intake rocker arm can also omit internal hydraulic supply.

An oil gallery 44 can be in communication with the capsule 300. The oil gallery can be configured to selectively actuate the deactivating mode and the oil gallery can be further configured to enable the lash adjusting function, as by ports and connections to the hydraulic lash assembly and the deactivating latch assembly, including hydraulic control H.

Figure 4:
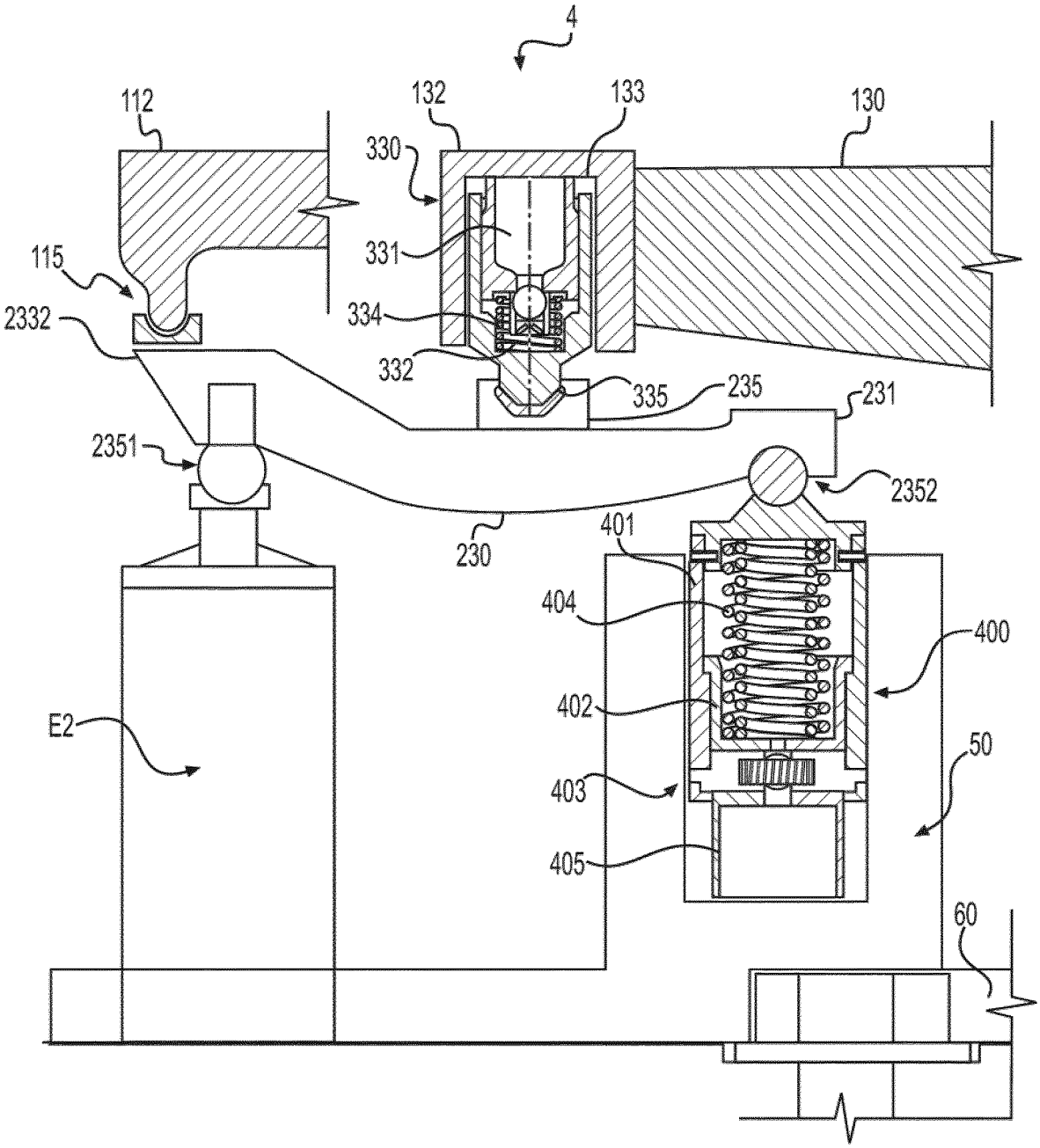

In the alternative of FIGS. 2B & 4, the valvetrain assembly 4 or 5 can comprise a lash adjuster 330 in a cavity 133 in the actuating end 132 of first rocker arm 130. Lash adjuster 330 an comprise an upper lash chamber 331, a check assembly 334, and a lower lash chamber 332. A knurl 335 can interface with an e-foot or socket at central pressure point 235 to actuate the rocker arm 130 against the valve bridge. The lash adjuster is configured to provide lash adjustment to the pair of engine valves E1, E2.

The capsule 400 is configured to selectively provide the deactivating mode. The capsule 400 comprises an interface with lower pivot point 2352. Capsule 400 can comprise a body 401 housing a lost motion spring 404, an actuating cup 402 for sliding in the body 401 and guiding the lost motion spring, a latch assembly 403, and a reaction block 405. Hydraulic control to the latch assembly 403 can collapse the latches so that the lower pivot point 2352 can compress the lost motion spring 404. The capsule 400 can be held in place in a tower 50 or other guide mounted to engine block 60.

The valve bridge 230 has a modified shape with pivot end 231 and two valve ends over the two valves E1, E2. Since the HLA is in the rocker arm 130, the second rocker arm 110 must act on the valve bridge 230 outside of the valve interfaces. Coupling at location 115 at actuating end 112 does not press down on the valve bridge over the valves E1 or E2. The offset pressure point 2332 is located outside a location above the valve interface 2351 above valve E2 or a location above the valve interface at valve E1. It can be said that the offset pressure point 2332 is outside a location bounded by the central pressure point 235, the first valve interface 2351, and the second valve interface.

In the valvetrain assemblies 1-5 it can be said that the central pressure point is in a location bounded by a point above the pivot point, a point above the first valve interface, and a point above the second valve interface so that the first rocker arm does not actuate against the valve bridge above either the first valve interface or the second valve interface.

Returning to FIG. 2B, the valvetrain assembly further comprises an oil gallery 44 in communication with the capsule 400. An oil control valve 40 can be in communication with the oil gallery 44. The oil gallery can be configured to selectively actuate the deactivating mode as by actuating the deactivating latch assembly 403. A second oil gallery 45 can be in communication with the lash adjuster 330 in the rocker arm 130. The second oil gallery 45 is configured to enable the lash adjusting function. The second oil gallery 45 can communicate with the rocker arm 130 by supplying oil to the rocker shaft 30, and the rocker shaft can be ported to a channel in the rocker arm 130.

Unlike prior work, the control for the oil gallery for cylinder deactivation, comprised of deactivating latch assemblies 303, 403 of capsule 300 or 400, is in a stationary portion of the rocker arm tower 50 or in the engine block. Also, when the lash adjuster is in the type III rocker arm, the hydraulic lash adjuster is moved so it is no longer directly over the valves and the HLA receives continuous pressure to avoid sponginess or pump up.

Other implementations will be apparent to those skilled in the art from consideration of the specification and practice of the examples disclosed herein.

What is claimed is:

1. A valvetrain assembly comprising:

a valve bridge comprising:

an upper surface comprising a central pressure point and an offset pressure point; and a lower surface comprising a lower pivot point, a first valve interface, and a second valve interface, the first and second valve interfaces configured to respectively press on a first engine valve and a second engine valve;

a capsule connected to the lower pivot point, the capsule configured to provide at least one of a lash adjusting function and a deactivating mode to the first engine valve and the second engine valve;

a first rocker arm configured to act on the central pressure point so as to transfer a first valve lift mode to the valve bridge; and a second rocker arm configured to act on the offset pressure point so as to transfer a second valve lift mode to the valve bridge.

2. The valvetrain assembly of claim 1, wherein the capsule is configured to provide the lash adjusting function and to selectively provide the deactivating mode to the first engine valve and the second engine valve.

3. The valvetrain assembly of claim 2, wherein the offset pressure point is located between the central pressure point and a location above the first valve interface.

4. The valvetrain assembly of claim 2, wherein the offset pressure point is at a location bounded by the central pressure point, the first valve interface, and the second valve interface.

5. The valvetrain assembly of claim 2, wherein the capsule provides the lash adjusting function, the deactivating mode, and an engine braking mode to the first engine valve and the second engine valve via a hydraulic supply that is not routed through the first rocker arm or the second rocker arm.

6. The valvetrain assembly of claim 2, further comprising an oil gallery in communication with the capsule, the oil gallery configured to selectively actuate the deactivating mode and to enable the lash adjusting function.

7. The valvetrain assembly of claim 1, wherein the first rocker arm includes a lash adjuster configured to provide lash adjustment to the first and second engine valves.

8. The valvetrain assembly of claim 7, wherein the capsule is configured to selectively provide the deactivating mode.

9. The valvetrain assembly of claim 7, wherein the offset pressure point is outside a location above the first valve interface or is above the second valve interface.

10. The valvetrain assembly of claim 7, wherein the offset pressure point is outside a location bounded by the central pressure point, the first valve interface, and the second valve interface.

11. The valvetrain assembly of claim 7, wherein the central pressure point is in a location bounded by a point above the lower pivot point, a point above the first valve interface, and a point above the second valve interface such that the central pressure point is offset from the first valve interface and the second valve interface.

12. The valvetrain assembly of claim 7, further comprising an oil gallery in communication with the capsule, the oil gallery configured to selectively actuate the deactivating mode.

13. The valvetrain assembly of claim 12, further comprising a second oil gallery in communication with the lash adjuster, the second oil gallery configured to enable the lash adjusting function.

14. The valvetrain assembly of claim 1, wherein the second valve lift mode is an engine braking mode.

15. The valvetrain assembly of claim 1, wherein the second valve lift mode is one of an early exhaust valve opening mode and a late intake valve closing mode.

* * * * *